US010052547B2

(12) United States Patent
Fream

(10) Patent No.: US 10,052,547 B2
(45) **Date of Patent: *Aug. 21, 2018**

(54) ADJUSTABLE SHOULDER PADS

(71) Applicant: CASCADE MAVERIK LACROSSE, LLC, Exeter, NH (US)

(72) Inventor: David Winthrop Fream, Newfields, NH (US)

(73) Assignee: CASCADE MAVERIK LACROSSE, LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/377,474

(22) Filed: Dec. 13, 2016

(65) Prior Publication Data

US 2017/0157493 A1 Jun. 8, 2017

Related U.S. Application Data

(63) Continuation of application No. 13/285,921, filed on Oct. 31, 2011, now Pat. No. 9,549,577.

(51) Int. Cl.

| | |
|---|---|
| ***A41D 27/26*** | (2006.01) |
| ***A63B 71/12*** | (2006.01) |
| ***A41D 13/05*** | (2006.01) |
| *A41D 13/00* | (2006.01) |

(52) U.S. Cl.

CPC ..... *A63B 71/12* (2013.01); *A41D 13/0512* (2013.01)

(58) Field of Classification Search

CPC ..... A63B 2071/1208; A63B 71/12; A63B 2209/10; A63B 21/065; A63B 2243/007; A63B 2071/1233; A63B 21/4007; A63B 2102/14; A63B 2102/24; A63B 71/08; A41D 13/0153; A41D 13/0518; A41D 13/0512; A41D 13/0015; A41D 13/015; A41D 13/05; A41D 13/0562; A41D 13/0568; A41D 27/26; A41D 13/0002; A41D 13/0556; A41D 31/0044

USPC .... 2/455, 456, 467, 44, 45, 92, 16, 17, 268, 2/270

See application file for complete search history.

(56) References Cited

U.S. PATENT DOCUMENTS

| | | | |
|---|---|---|---|
| 2,527,844 | A | 10/1950 | Owen |
| 4,302,849 | A | 12/1981 | Margetson |
| 4,580,408 | A | 4/1986 | Stuebner |
| 4,785,803 | A | 11/1988 | Benckhuijsen |
| 4,887,318 | A | 12/1989 | Weinreb |
| 5,129,101 | A | 7/1992 | Douglas |
| 5,135,470 | A | 8/1992 | Reeves |

(Continued)

OTHER PUBLICATIONS

Non Final Office Action dated Feb. 21, 2013 issued in connection with U.S. Appl. No. 13/285,921, 10 pages.

(Continued)

*Primary Examiner* — Bobby Muromoto, Jr.

(57) ABSTRACT

Shoulder pads for a player playing a contact sport, such as hockey, lacrosse or football, are provided. The shoulder pads comprise a front member, a back member, left and right shoulder arches, left and right shoulder protectors, and an adjustment system allowing the player to adjust a fit of the shoulder pads. The adjustment system may allow the player to adjust various components of the shoulder pads, including the front member, the back member, and the left and right shoulder protectors, in various directions.

67 Claims, 12 Drawing Sheets

(56) References Cited

U.S. PATENT DOCUMENTS

| | | | | |
|---|---|---|---|---|
| 5,159,715 | A | 11/1992 | Jurga et al. | |
| 5,173,964 | A | 12/1992 | Ball et al. | |
| 5,240,538 | A | 8/1993 | Hyams et al. | |
| 5,319,806 | A | 6/1994 | Hermann et al. | |
| 5,398,339 | A | 3/1995 | Wagner | |
| 5,742,947 | A | 4/1998 | Davis | |
| 5,961,019 | A | 10/1999 | Gleason et al. | |
| 6,035,452 | A | 3/2000 | Braxton | |
| 6,145,134 | A | 11/2000 | Davis et al. | |
| 6,510,560 | B1 | 1/2003 | Ugolnik | |
| 6,748,601 | B2 | 6/2004 | LaShoto et al. | |
| 6,842,915 | B2 | 1/2005 | Turner et al. | |
| 7,487,556 | B2 | 2/2009 | Morrow et al. | |
| 7,647,651 | B2 | 1/2010 | Contant et al. | |
| 7,730,549 | B2 | 6/2010 | Morrow et al. | |
| 7,797,760 | B2 | 9/2010 | Morrow et al. | |
| 7,930,773 | B2 | 4/2011 | Ide et al. | |
| 9,549,577 | B2 * | 1/2017 | Fream ..... | A41D 13/0512 |
| 2004/0210992 | A1 | 10/2004 | Morrow et al. | |
| 2007/0011798 | A1 | 1/2007 | Hunt | |
| 2007/0050886 | A1 | 3/2007 | Brassill | |
| 2008/0040828 | A1 | 2/2008 | Morrow et al. | |
| 2008/0040840 | A1 | 2/2008 | Morrow et al. | |
| 2008/0040841 | A1 | 2/2008 | Morrow et al. | |
| 2008/0092281 | A1 | 4/2008 | Morrow et al. | |
| 2009/0235440 | A1 | 9/2009 | Udelhofen | |
| 2010/0192287 | A1 | 8/2010 | Kraemer et al. | |
| 2010/0306908 | A1 | 12/2010 | Fiegener | |
| 2011/0247130 | A1 | 10/2011 | Lewandowski | |
| 2013/0000021 | A1 | 1/2013 | Dolcetti | |

OTHER PUBLICATIONS

Non-Final Office Action dated Aug. 26, 2015 issued in connection with U.S. Appl. No. 13/285,921, 15 pages.

Notice of Allowance dated Sep. 12, 2016 issued in connection with U.S. Appl. No. 13/285,921, 11 pages.

* cited by examiner

ADJUSTABLE SHOULDER PADS

FIELD OF THE INVENTION

The invention relates generally to protective sporting equipment and, more particularly, to shoulder pads for a player playing a contact sport such as hockey, lacrosse or football.

BACKGROUND OF THE INVENTION

Shoulder pads are worn by players of contact sports, such as hockey, lacrosse and football, for upper body protection. Typically, shoulder pads comprise front and back members for respectively protecting front and back regions of a player's thorax and left and right shoulder protectors for respectively protecting the player's left and right shoulders.

A fit of a player's shoulder pads can be important to properly protect the player and facilitate movement of the player. However, the shoulders pads may be limited in terms of how well they can fit the player and this may adversely affect protection and/or movement of the player. For example, the shoulder pads' front and back members may be sewn or otherwise permanently joined such that their shoulder arches arching over the player's shoulders and interconnecting the front and back members are fixed. This may cause the shoulder pads to "sit" or lay poorly on the player. For instance, the shoulder pads may "float" on top of the player, i.e., they may not lay down on the player's shoulders between the player's chest and back. Also, the shoulder arches may be padded and their fixed nature may cause their padding to bunch up or not flex properly.

For these and other reasons, there is a need for improvements in shoulder pads, including improvements directed to improving a fit of a player's shoulder pads.

SUMMARY OF THE INVENTION

According to an aspect of the invention, shoulder pads for a player playing a contact sport are provided. The shoulder pads comprise: a front member for covering at least part of a front side of a thorax of the player, the front member comprising protective padding; a back member for covering at least part of a back side of the thorax of the player; a left shoulder arch for arching over a left shoulder of the player and interconnecting the front member and the back member; a right shoulder arch for arching over a right shoulder of the player and interconnecting the front member and the back member; a neck opening for receiving a neck of the player, the neck opening being defined by the front member, the back member, the left shoulder arch, and the right shoulder arch; a left shoulder protector for protecting at least part of the left shoulder of the player; a right shoulder protector for protecting at least part of the right shoulder of the player; a left shoulder arch fastener detachably fastening the left shoulder arch to a given one of the front member and the back member to allow the player to adjust the left shoulder arch, the left shoulder arch fastener comprising a first connector on the left shoulder arch and a second connector on the given one of the front member and the back member, the first connector of the left shoulder arch fastener overlapping the given one of the front member and the back member and being detachably connected to the second connector of the left shoulder arch fastener; and a right shoulder arch fastener detachably fastening the right shoulder arch to the given one of the front member and the back member to allow the player to adjust the right shoulder arch, the right shoulder arch fastener comprising a first connector on the right shoulder arch and a second connector on the given one of the front member and the back member, the first connector of the right shoulder arch fastener overlapping the given one of the front member and the back member and being detachably connected to the second connector of the right shoulder arch fastener.

According to another aspect of the invention, shoulder pads for a player playing a contact sport are provided. The shoulder pads comprise: a front member for covering at least part of a front side of a thorax of the player, the front member comprising protective padding; a back member for covering at least part of a back side of the thorax of the player; a left shoulder arch for arching over a left shoulder of the player and interconnecting the front member and the back member; a right shoulder arch for arching over a right shoulder of the player and interconnecting the front member and the back member; a neck opening for receiving a neck of the player, the neck opening being defined by the front member, the back member, the left shoulder arch, and the right shoulder arch; a left shoulder protector for protecting at least part of the left shoulder of the player; a right shoulder protector for protecting at least part of the right shoulder of the player; a left shoulder arch fastener detachably fastening the left shoulder arch to the front member to allow the player to adjust the left shoulder arch, the left shoulder arch fastener allowing the player to adjust a position in which the left shoulder arch is detachably fastened to the front member in a front-back direction of the shoulder pads and in a left-right direction of the shoulder pads; and a right shoulder arch fastener detachably fastening the right shoulder arch to the front member to allow the player to adjust the right shoulder arch, the right shoulder arch fastener allowing the player to adjust a position in which the right shoulder arch is detachably fastened to the front member in the front-back direction of the shoulder pads and in the left-right direction of the shoulder pads.

According to another aspect of the invention, shoulder pads for a player playing a contact sport are provided. The shoulder pads comprise: a front member for covering at least part of a front side of a thorax of the player, the front member comprising protective padding; a back member for covering at least part of a back side of the thorax of the player; a left shoulder arch for arching over a left shoulder of the player and interconnecting the front member and the back member; a right shoulder arch for arching over a right shoulder of the player and interconnecting the front member and the back member; a neck opening for receiving a neck of the player, the neck opening being defined by the front member, the back member, the left shoulder arch, and the right shoulder arch; a left shoulder protector for protecting at least part of the left shoulder of the player; a right shoulder protector for protecting at least part of the right shoulder of the player; a first hook-and-loop fastener detachably fastening the left shoulder arch to the front member to allow the player to adjust the left shoulder arch, the first hook-and-loop fastener comprising a hook portion and a loop portion that are provided on respective ones of the left shoulder arch and the front member; and a second hook-and-loop fastener detachably fastening the right shoulder arch to the front member to allow the player to adjust the right shoulder arch, the second hook-and-loop fastener comprising a hook portion and a loop portion that are provided on respective ones of the right shoulder arch and the front member.

According to another aspect of the invention, shoulder pads for a player playing a contact sport are provided. The shoulder pads comprise: a front member for covering at least part of a front side of a thorax of the player, the front member comprising protective padding; a back member for covering at least part of a back side of the thorax of the player; a left shoulder arch for arching over a left shoulder of the player and interconnecting the front member and the back member; a right shoulder arch for arching over a right shoulder of the player and interconnecting the front member and the back member; a neck opening for receiving a neck of the player, the neck opening being defined by the front member, the back member, the left shoulder arch, and the right shoulder arch; a left shoulder protector for protecting at least part of the left shoulder of the player; a right shoulder protector for protecting at least part of the right shoulder of the player; and an adjustment system for allowing the player to adjust the shoulder pads, the adjustment system holding the front member and the back member together and being unfastenable to disconnect the front member and the back member from one another such that the front member and the back member are separated.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
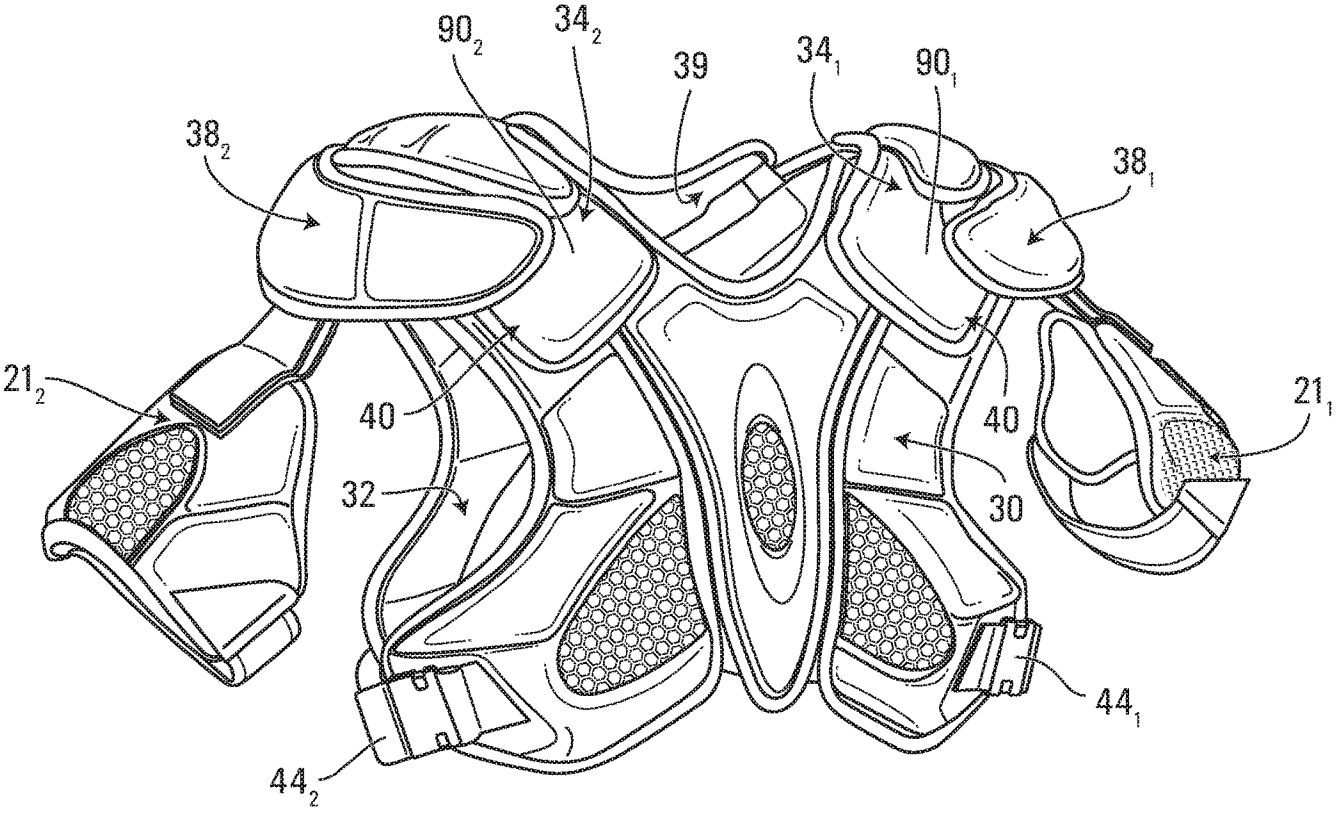
FIG. 1 shows a perspective view of an example of shoulder pads for upper body protection of a player in accordance with an embodiment of the invention.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, unless otherwise indicated, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

FIG. 1 shows an example of shoulder pads 10 for upper body protection of a player playing a contact sport in accordance with an embodiment of the invention. In this embodiment, the player is a lacrosse player playing lacrosse and thus the shoulder pads 10 are lacrosse shoulder pads.

Figure 12B:
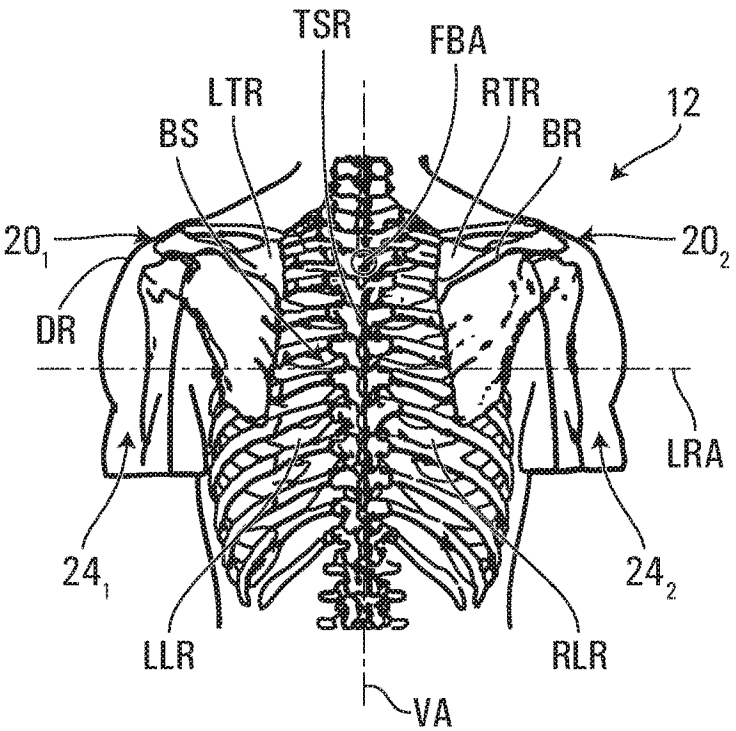
FIGS. 12A and 12B, respectively, show front and back views of regions of an upper body of the player.
Figure 12A:
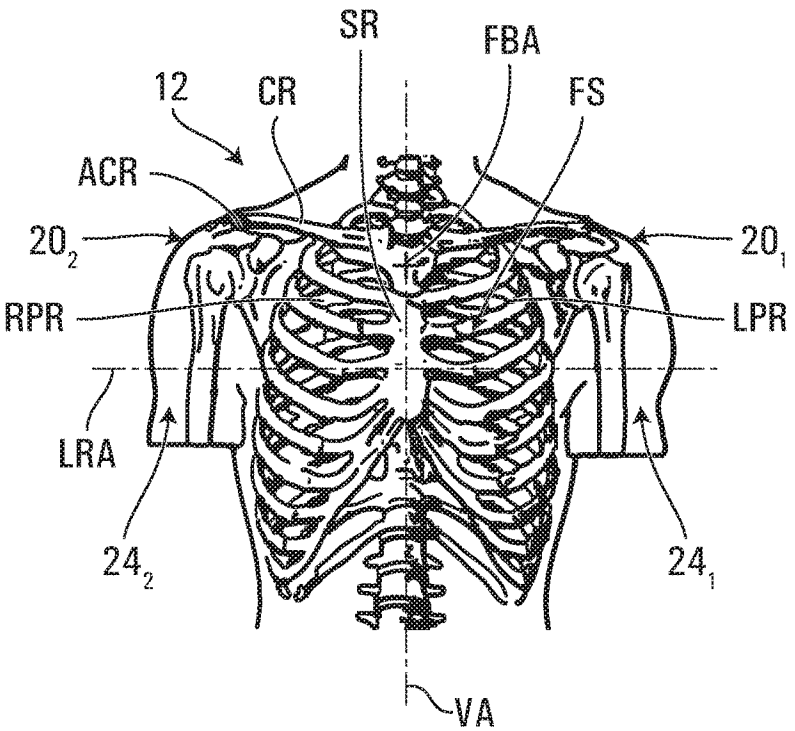

The shoulder pads 10 protect various regions of an upper body of the player. As shown in FIG. 12, a thorax 12 of the player has a front side FS and a back side BS. The front side FS of the thorax 12, which can also be referred to as a "chest" or "ventral" side, comprises left and right pectoral regions LPR, RPR overlying left and right pectoral muscles of the player and a sternum region SR overlying a sternum of the player. The back side BS of the thorax 12, which can also be referred to as a "dorsal" side, comprises a thoracic spinal region TSR overlying thoracic vertebrae of the player, left and right trapezius regions LTR, RTR overlying left and right trapezius muscles of the player, and left and right latissimus dorsi regions LLR, RLR overlying left and right latissimus dorsi muscles of the player. Left and right left shoulders $\mathbf{20}_1$, $\mathbf{20}_2$ of the player join left and right arms $\mathbf{24}_1$, $\mathbf{24}_2$ of the player to the thorax 12. Each of the left and right shoulders $\mathbf{20}_1$, $\mathbf{20}_2$ has a clavicle region CR, a scapular region BR, an acromioclavicular joint region ACR, and a deltoid region DR respectively overlying a clavicle, a scapula, an acromioclavicular joint, and a deltoid muscle of that shoulder. The upper body of the player 14 has a front-back (i.e., a dorso-ventral) axis FBA (which is perpendicular to the front and back views shown in FIG. 12), a left-right (i.e., dextro-sinistral) axis LRA, and a vertical (i.e., cephalo-caudal) axis VA.

Figure 2:
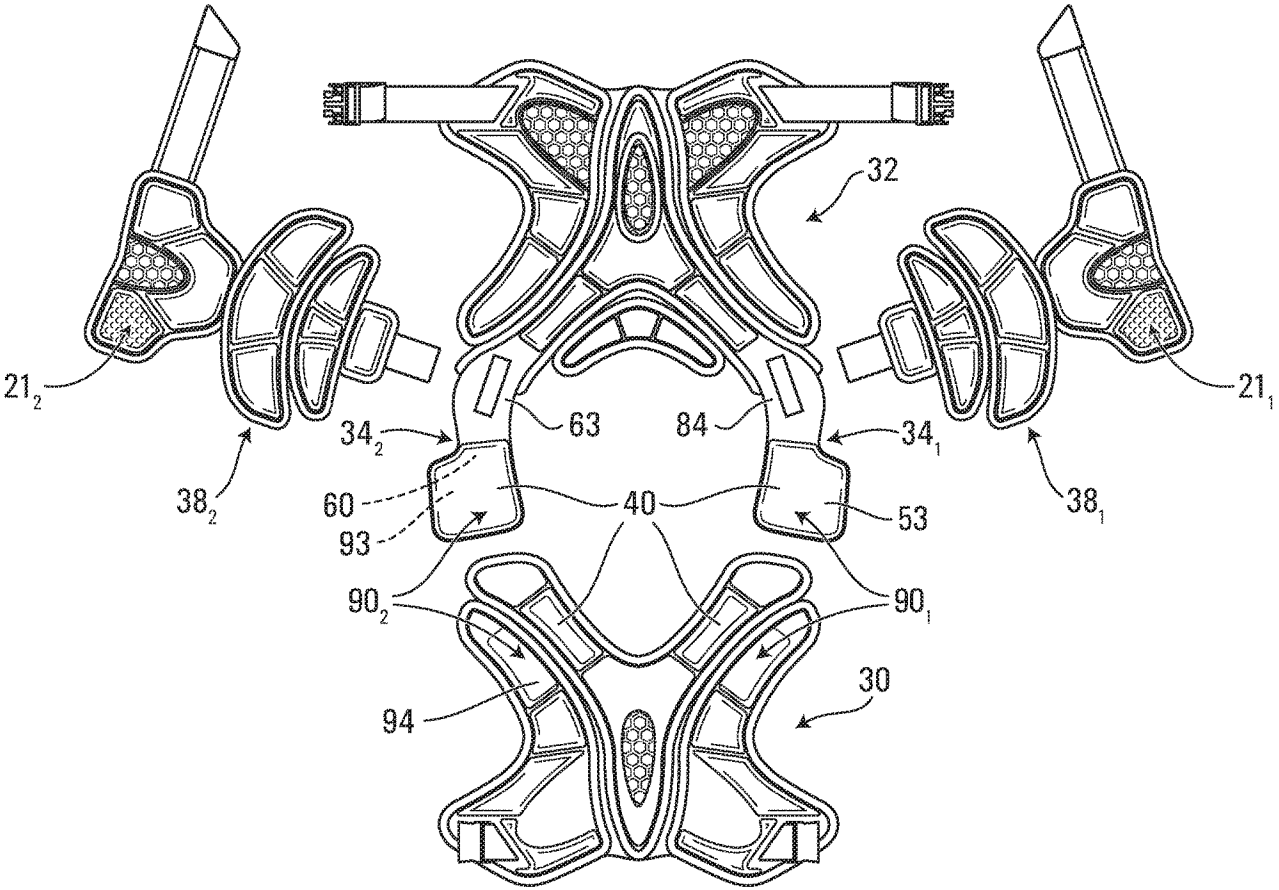
FIG. 2 shows an exploded view of the shoulder pads.

With additional reference to FIG. 2, the shoulder pads 10 comprise a front member 30, a back member 32, left and right shoulder arches $\mathbf{34}_1$, $\mathbf{34}_2$, and left and right shoulder protectors $\mathbf{38}_1$, $\mathbf{38}_2$. A front-back direction, a left-right direction, and a top-bottom direction of the shoulder pads 10 are respectively parallel to the front-back axis FBA, the left-right axis LRA, and the vertical axis VA of the upper body of the player. The front member 30, the back member 32, and the left and right shoulder arches $\mathbf{34}_1$, $\mathbf{34}_2$ define a neck opening 39 for receiving a neck of the player. In this embodiment, the shoulder pads 10 also comprise left and right arm protectors $\mathbf{21}_1$, $\mathbf{21}_2$ and left and right lower straps $\mathbf{44}_1$, $\mathbf{44}_2$.

As further discussed later, the shoulder pads 10 comprise an adjustment system 40 allowing the player to adjust a fit of the shoulder pads 10. More particularly, in this embodiment, the adjustment system 40 allows the player to adjust the left and right shoulder arches $\mathbf{34}_1$, $\mathbf{34}_2$. In this example, this enables components of the shoulder pads 10, including the front member 30, the back member 32, and the left and right shoulder protectors $\mathbf{38}_1$, $\mathbf{38}_2$, to be adjusted in various directions, including the front-back direction and the left-right direction of the shoulder pads 10, while the player is wearing the shoulder pads 10.

Figure 3:
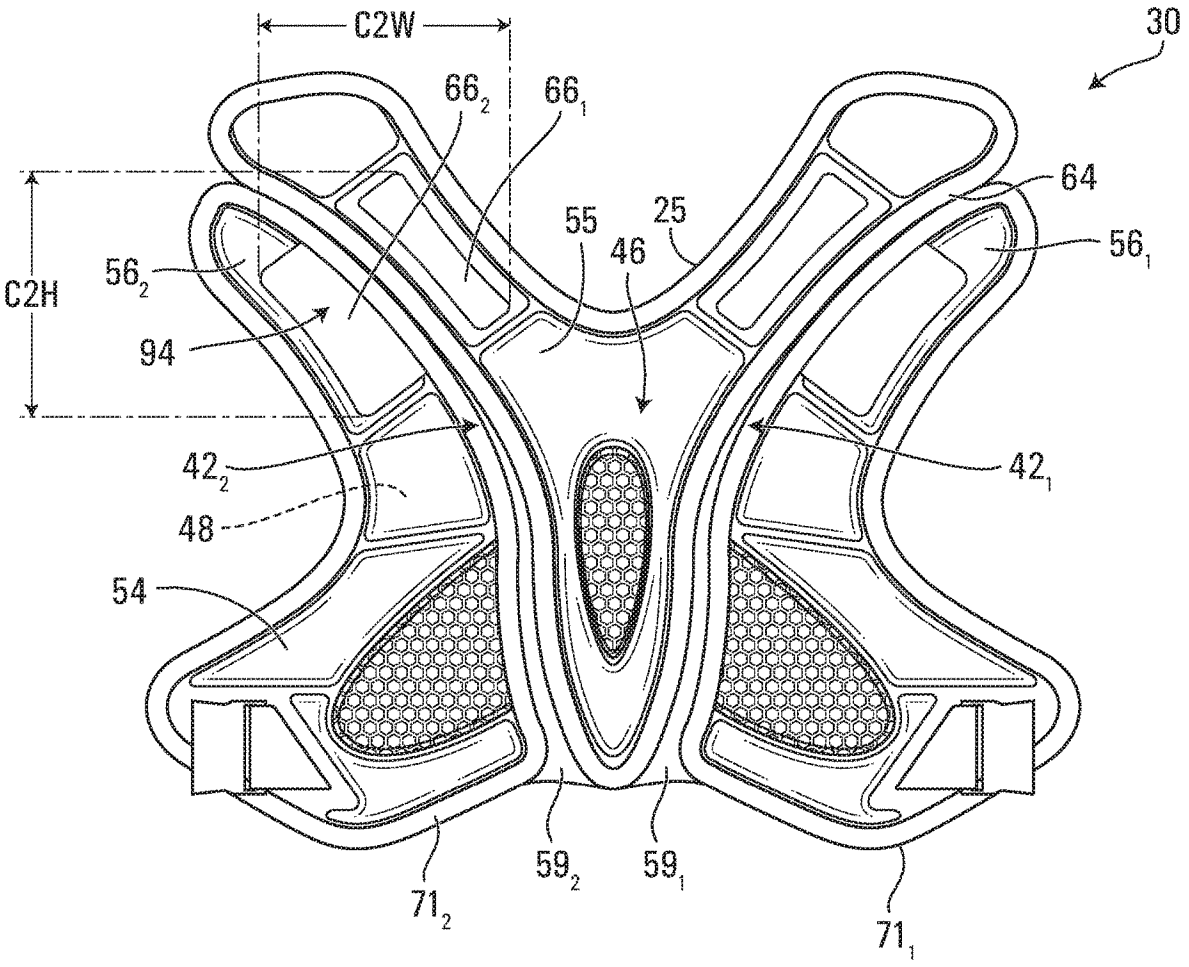
FIGS. 3 and 4 respectively show plan views of an outer side and an inner side of a front member of the shoulder pads.
Figure 4:
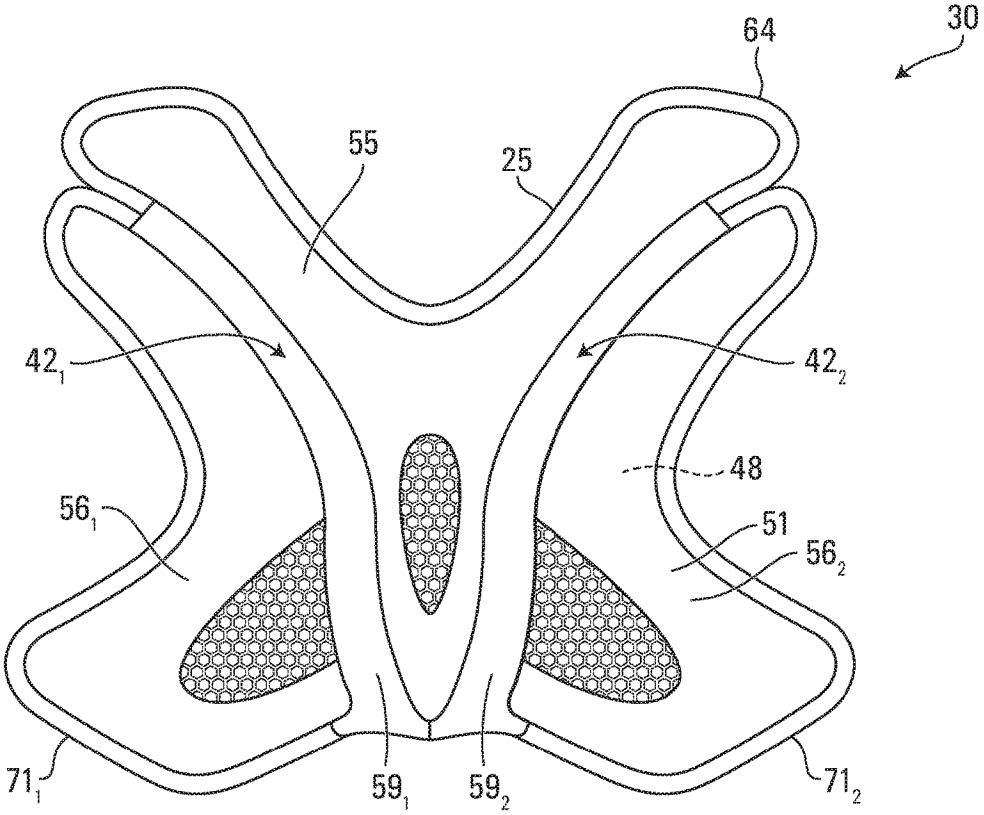

The front member 30 is configured to cover at least part of the front side FS of the thorax 12 of the player. With additional reference to FIGS. 3 and 4, the front member 30, which can also be referred to as a front "panel", comprises left and right pectoral portions $42_1$, $42_2$ for covering the left and right pectoral regions LPR, RPR of the player and a sternum portion 46 for covering the sternum region SR of the player. The front member 30 comprises a top edge 25 delimiting the neck opening 39.

In this embodiment, the front member 30 comprises protective padding 48 disposed between an inner liner 51 and an outer covering 54. The protective padding 48 provides padded protection to the left and right pectoral regions LPR, RPR and the sternum region SR of the player. The protective padding 48 may comprise any suitable shock-absorbing material. For example, in this embodiment, the protective padding 48 comprises foam material. The foam material of the protective padding 48 may comprise any suitable foam. For instance, in some examples of implementation, the foam material of the protective padding 48 may comprise ethylene vinyl acetate (EVA) foam, expanded polypropylene (EPP) foam, expanded polyethylene (EPE) foam), vinyl nitrile (VN) foam, or any other suitable foam. In some cases, the foam material of the protective padding 48 may include only one type of foam. In other cases, the foam material of the protective padding 48 may include different types of foam in different areas of the front member 30. Also, in some embodiments, the protective padding 48 may comprise shock-absorbing material other than foam. For instance, in some cases, the protective padding 48 may comprises gel material (e.g., in the sternum portion 46 for providing added protection to the sternum region SR of the player).

The inner liner 51 comprises fabric material. The fabric material of the inner liner 51 may comprise any suitable fabric. For instance, in some examples of implementation, the fabric material of the inner liner 51 may comprise a woven fabric, a nonwoven fabric, synthetic microfibers, a synthetic woven knit, a polyurethane laminate, a mesh, or any other suitable fabric. In some cases, the fabric material of the inner liner 51 may include only one type of fabric. In other cases, the fabric material of the inner liner 51 may include different types of fabric in different areas of the front member 30. The outer covering 54 may comprise any suitable material. For example, in this embodiment, the outer covering 54 comprises flexible non-foam polymeric material (e.g., polyurethane).

In this embodiment, the front member 30 comprises a central section 55 and a pair of lateral sections $56_1$, $56_2$ connected to one another, with the central section 55 located between the lateral sections $56_1$, $56_2$. The central section 55 comprises central portions of the protective padding 48, the inner liner 51, and the outer covering 54, which, in this example, are interconnected by a stitched connecting band 64 that extends along a perimeter of the central section 55. Similarly, the lateral sections $56_1$, $56_2$ respectively comprise lateral portions of the protective padding 48, the inner liner 51, and the outer covering 54, which, in this example, are respectively interconnected by stitched connecting bands $71_1$, $71_2$ that extend along perimeters of the lateral sections $56_1$, $56_2$.

In this example of implementation, each of the lateral sections $56_1$, $56_2$ is movable relative to the central section 55. This may facilitate movement of the player during play. This may also facilitate adjustment of the front member 30 on the player. More particularly, in this embodiment, the central section 55 is connected to the lateral sections $56_1$, $56_2$ by elastic zones $59_1$-$59_2$ which stretch when the lateral sections $56_1$, $56_2$ are subjected to forces moving the lateral sections $56_1$, $56_2$ away from the central section 55 and which contract when these forces are no longer applied to bias the lateral sections $56_1$, $56_2$ back towards the central section 55. For instance, in this embodiment, each of the elastic zones $59_1$-$59_2$ may comprise an elastic "stretch" fabric (e.g., spandex material).

The front member 30 may be implemented in various other ways in other embodiments. For example, in other embodiments, the front member 30 may have various other shapes, comprise various other components, and/or be made of various other materials. For instance, in some embodiments, the front member 30 may comprise an outer shell of rigid material (e.g., one or more shell pieces of polycarbonate or other rigid polymeric material). As another example, in other embodiments, the front member 30 may not comprise central and lateral sections which can move relative to one another.

Figure 5:
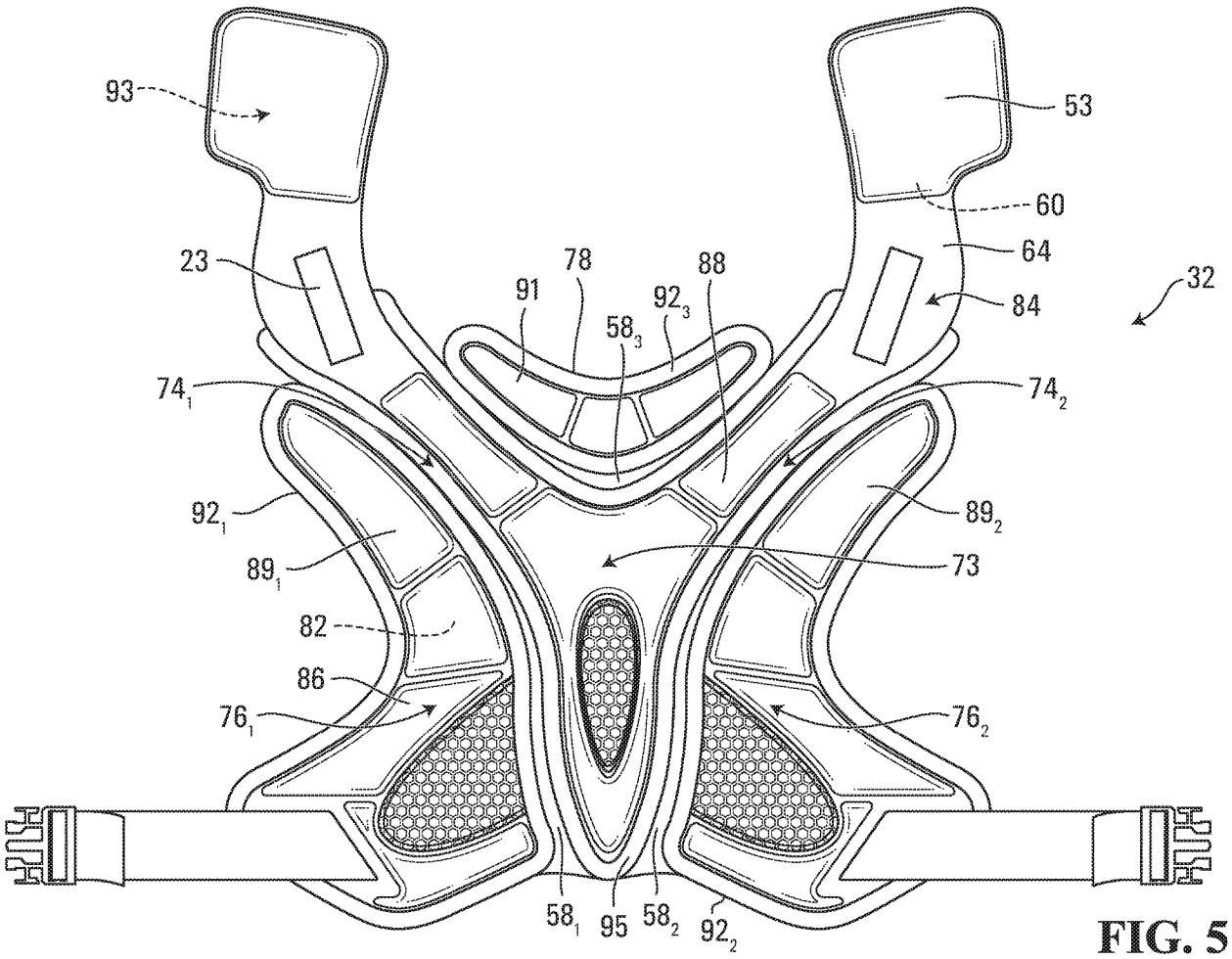
FIGS. 5 and 6 respectively show plan views of an outer side and an inner side of a back member of the shoulder pads.
Figure 6:
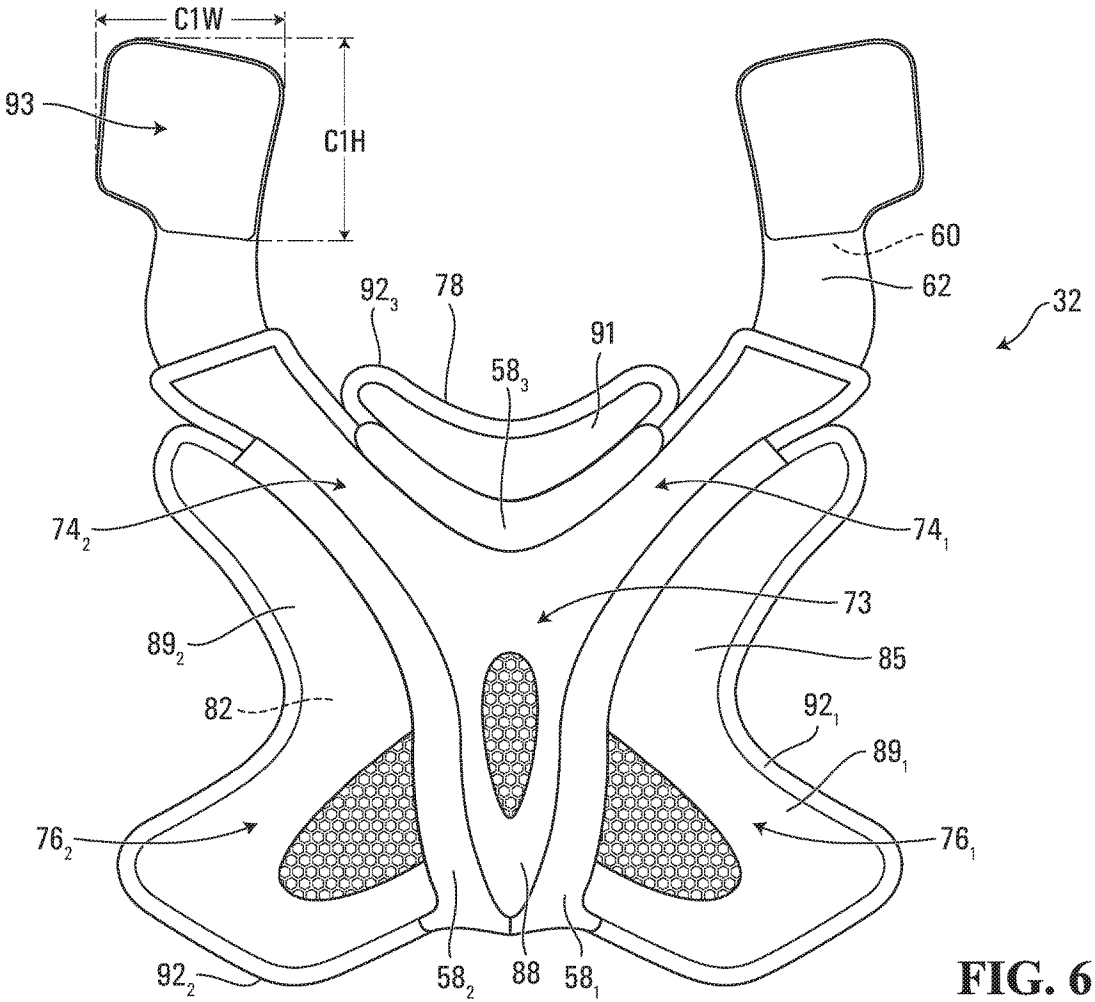

The back member 32 is configured to cover at least part of the back side BS of the thorax 12 of the player. With additional reference to FIGS. 5 and 6, the back member 32, which can also be referred to as a back "panel", comprises a spinal portion 73 for covering the thoracic spinal region TSR of the player 14. In this embodiment, the back member 32 also comprises left and right trapezius portions $74_1$, $74_2$ for covering the left and right trapezius regions LTR, RTR of the player and left and right latissimus dorsi portions $76_1$, $76_2$ for covering the left and right latissimus dorsi regions LLR, RLR of the player. The back member 32 comprises a top edge 78 delimiting the neck opening 39.

In this embodiment, the back member 32 comprises protective padding 82 disposed between an inner liner 85 and an outer covering 86. In this case, these components of the back member 32 are similar in construction to the protective padding 48, the inner liner 51, and the outer covering 54 of the front member 30. The protective padding 82 provides padded protection to the thoracic spinal region SR, the left and right trapezius regions LTR, RTR, and left and right latissimus dorsi regions LLR, RLR of the player.

In this embodiment, the back member 32 comprises a central section 88, a pair of lateral sections $89_1$, $89_2$, and a top section 91 connected to one another, with the central section 88 located between the lateral sections $89_1$, $89_2$ and below the top section 91. The central section 88 comprises central portions of the protective padding 82, the inner liner 85, and the outer covering 86, which, in this example, are interconnected by a stitched connecting band 95 that extends along a perimeter of the central section 88. Similarly, the lateral sections $89_1$, $89_2$ and the top section 91 respectively comprise lateral and top portions of the protective padding 82, the inner liner 85, and the outer covering 86, which, in this example, are respectively interconnected by stitched connecting bands $92_1$-$92_3$ that extend along perimeters of the lateral sections $89_1$, $89_2$ and the top section 91.

In this example of implementation, each of the lateral sections $89_1$, $89_2$ and the top section 91 is movable relative to the central section 88 by virtue of elastic zones $58_1$-$58_3$ which stretch and contract when the lateral sections $89_1$, $89_2$ and the top section 91 are subjected to forces moving them relative to the central section 88, similar to the elastic zones $59_1$-$59_2$ of the front member 30.

The back member 32 may be implemented in various other ways in other embodiments. For example, in other embodiments, the back member 32 may have various other shapes, comprise various other components, and/or be made of various other materials. For instance, in some embodiments, the back member 32 may comprise an outer shell of rigid material (e.g., one or more shell pieces of polycarbonate or other rigid polymeric material). As another example, in other embodiments, the back member 32 may not comprise central, lateral and top sections which can move relative to one another.

In this embodiment, as shown in FIG. 2, the front member 30 and the back member 32 are separate members which are held together by the adjustment system 40 and which are disconnectable from one another by unfastening the adjustment system 40, as further discussed later. That is, the adjustment system 40 is unfastenable to disconnect the front member 30 and the back member 32 such that the front and back members 30, 32 are separated. More particularly, in this example, the front member 30 and the back member 32 can be detached from one another at their top by unfastening the adjustment system 40 and can be detached from one another at their bottom by unfastening the lower straps $\mathbf{44}_1$, $\mathbf{44}_2$.

The left shoulder arch $\mathbf{34}_1$ is configured to arch over the left shoulder $\mathbf{20}_1$ of the player and interconnects the front member 30 and the back member 32. Similarly, the right shoulder arch $\mathbf{34}_2$ is configured to arch over the right shoulder $\mathbf{20}_2$ of the player and interconnects the front member 30 and the back member 32. Each shoulder arch $\mathbf{34}_x$ comprises a clavicle portion 53 and a scapular portion 84 for respectively overlying the clavicle region CR and the scapular region BR of the shoulder $\mathbf{20}_x$ over which it arches.

In this embodiment, the shoulder arch $\mathbf{34}_x$ comprises protective padding 60 disposed between an inner liner 62 and an outer covering 63. The protective padding 60 provides padded protection to the clavicle region CR and the scapular region BR of the shoulder $\mathbf{20}_x$. The protective padding 60 may comprise any suitable shock-absorbing material. For example, in this embodiment, the protective padding 60 comprises foam material. The foam material of the protective padding 60 may comprise any suitable polymeric foam. For instance, in some examples of implementation, the foam material of the protective padding 60 may comprise any foam previously mentioned herein. In some cases, the foam material of the protective padding 60 may include only one type of foam. In other cases, the foam material of the protective padding 60 may include different types of foam in different areas of the shoulder arch $\mathbf{34}_x$.

The inner liner 62 comprises fabric material. The fabric material of the inner liner 62 may comprise any suitable fabric. For instance, in some examples of implementation, the fabric material of the inner liner 62 may comprise any fabric previously mentioned herein. In some cases, the fabric material of the inner liner 62 may include only one type of fabric. In other cases, the fabric material of the inner liner 62 may include different types of fabric in different areas of the shoulder arch $\mathbf{34}_x$. The outer covering 63 may comprise any suitable material. For example, in this embodiment, the outer covering 63 comprises flexible non-foam polymeric material (e.g., polyurethane).

In this embodiment, the shoulder arch $\mathbf{34}_x$ constitutes a shoulder-arching strap extending from the back member 32 towards the front member 30. More particularly, in this embodiment, the shoulder-arching strap constituted by the shoulder arch $\mathbf{34}_x$ is nonseparably connected to the back member 32 (i.e., it is connected to the back member 32 such that it cannot be separated from the back member 32 without damaging the shoulder pads 10) and extends towards the front member 30. In this case, the shoulder-arching strap constituted by the shoulder arch $\mathbf{34}_x$ is nonseparably connected to the back member 32 by being sewed to the back member 32. In other cases, the shoulder-arching strap constituted by the shoulder arch $\mathbf{34}_x$ may be nonseparably connected to the back member 32 in other ways (e.g., by being integrally formed with the back member 32). In other embodiments, the shoulder-arching strap constituted by the shoulder arch $\mathbf{34}_x$ may be detachable from the back member 32.

The left and right shoulder arches $\mathbf{34}_1$, $\mathbf{34}_2$ may be implemented in various other ways in other embodiments. For example, in other embodiments, each of the left and right shoulder arches $\mathbf{34}_1$, $\mathbf{34}_2$ may have various other shapes, comprise various other components, and/or be made of various other materials. For instance, in other embodiments, instead of constituting a strap, each of left and right shoulder arches $\mathbf{34}_1$, $\mathbf{34}_2$ may comprise a cord or wire that interconnects the front member 30 and the back member 32.

Figure 7:
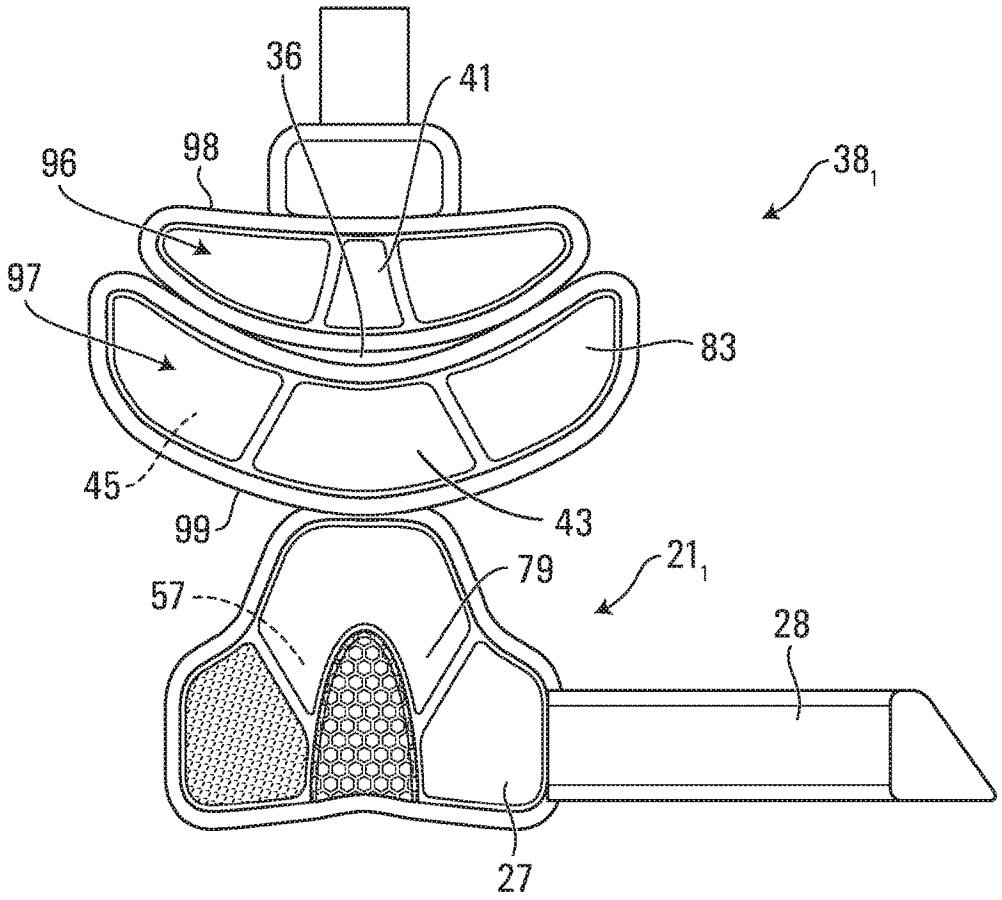
FIGS. 7 and 8 respectively show plan views of an outer side and an inner side of a shoulder protector and an arm protector of the shoulder pads.
Figure 8:
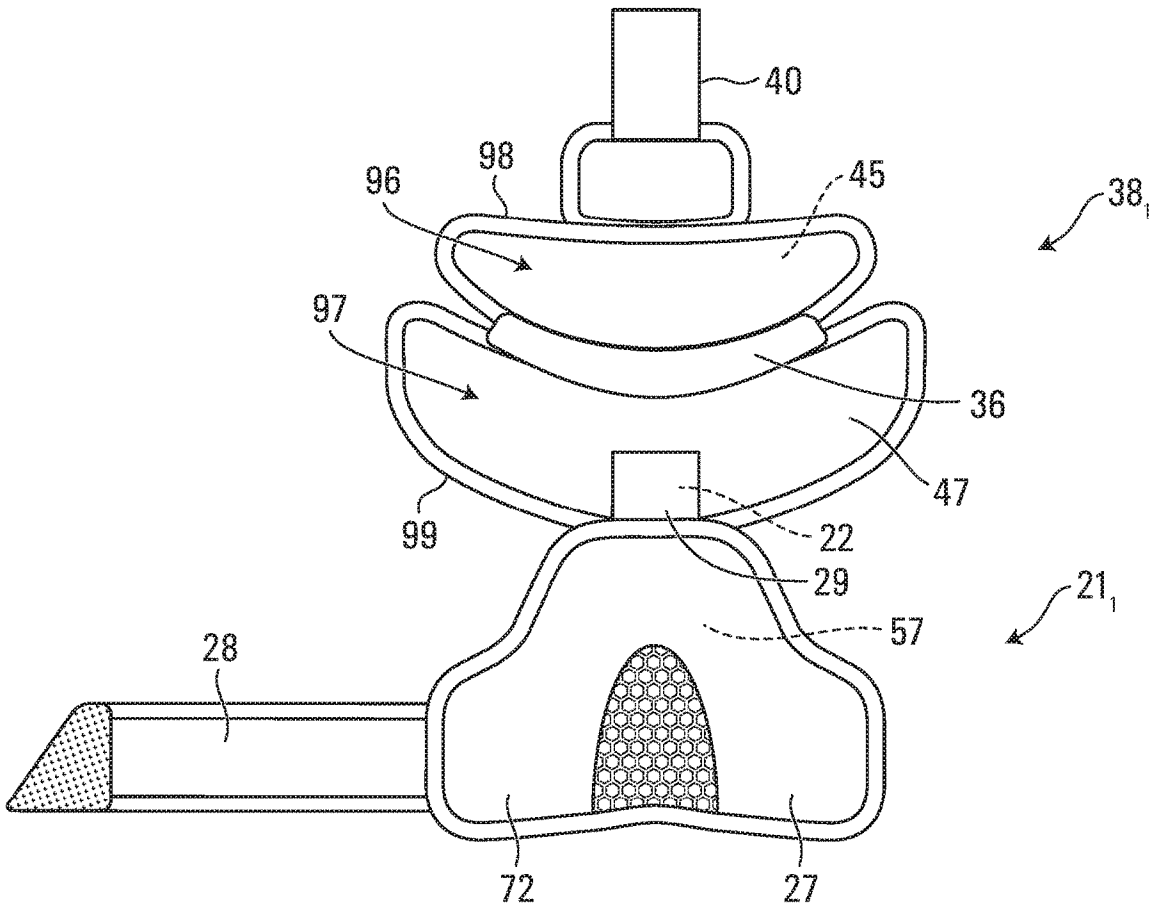
Figure 9B:
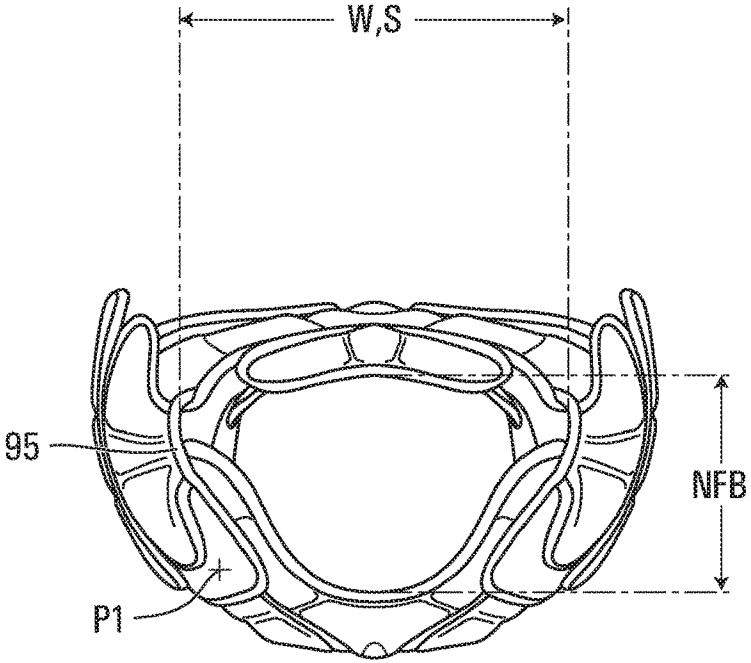
FIGS. 9A, 9B, 10A and 10B show examples of adjustments of the shoulder pads using an adjustment system of the shoulder pads.
Figure 9A:
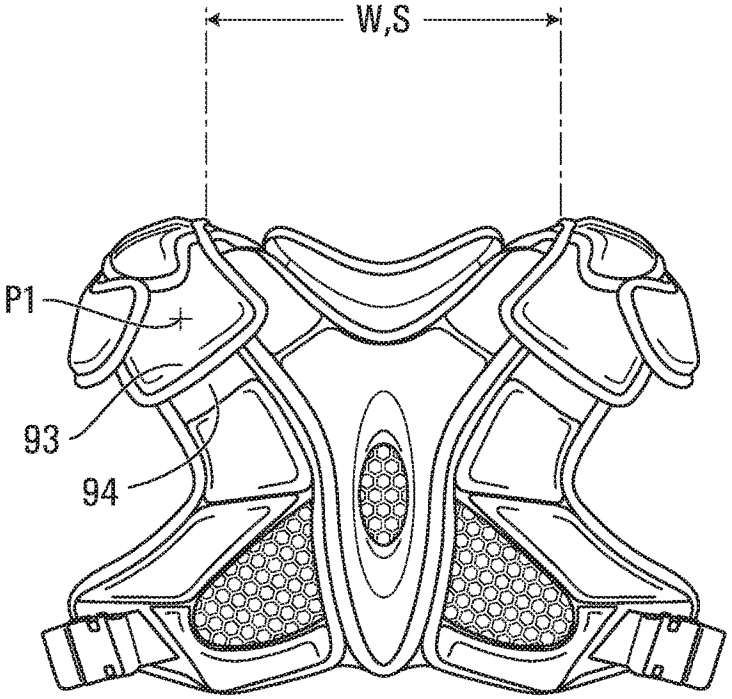
Figure 10B:
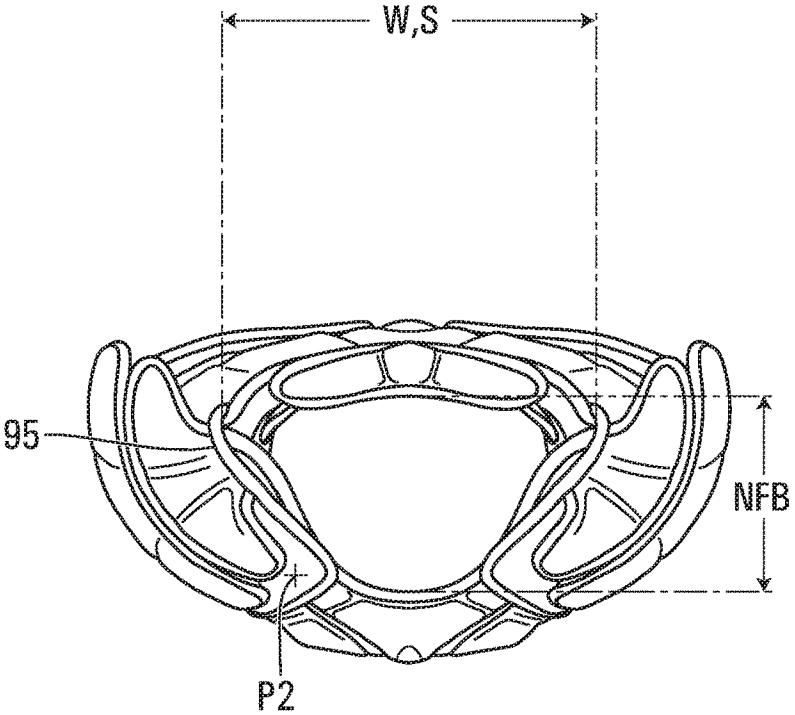
Figure 10A:
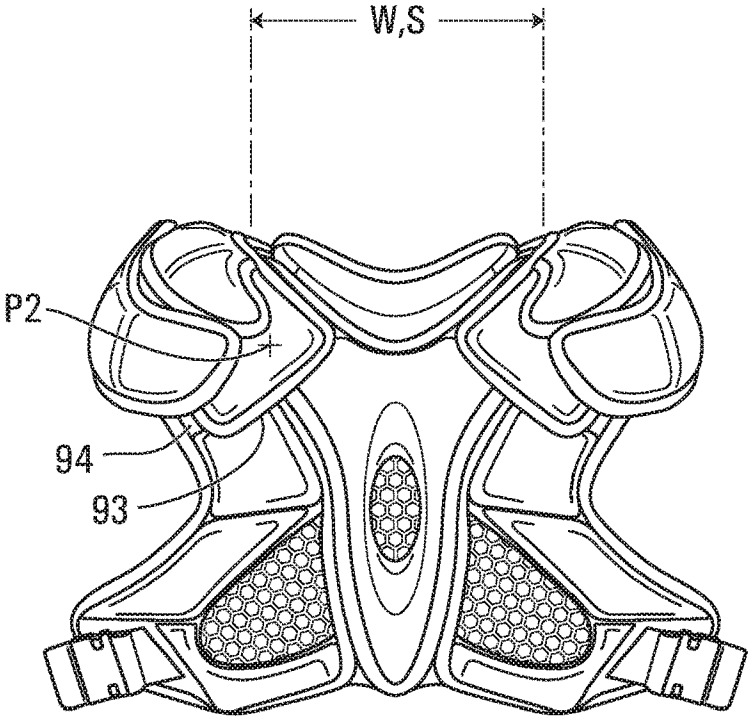

The left shoulder protector $\mathbf{38}_1$ is configured to protect at least part of the left shoulder $\mathbf{20}_1$ of the player. Similarly, the right shoulder protector $\mathbf{38}_2$ is configured to protect at least part of the right shoulder $\mathbf{20}_2$ of the player. With additional reference to FIGS. 7 and 8, each shoulder protector $\mathbf{38}_x$ comprises an acromioclavicular joint portion 41 and a deltoid portion 43 for respectively overlying the acromioclavicular joint region ACR and the deltoid region DR of the shoulder $\mathbf{20}_x$ it protects. The shoulder protector $\mathbf{38}_x$ forms a shoulder "cap" of the shoulder pads 10 for the shoulder $\mathbf{20}_x$.

In this embodiment, the shoulder protector $\mathbf{38}_x$ is mounted over the shoulder arch $\mathbf{34}_x$ arching the shoulder $\mathbf{20}_x$. Also, in this embodiment, the shoulder protector $\mathbf{38}_x$ is movable relative to the shoulder arch $\mathbf{34}_x$. More particularly, in this example, the shoulder protector $\mathbf{38}_x$ is pivotable relative to the shoulder arch $\mathbf{34}_x$. In this case, the shoulder protector $\mathbf{38}_x$ comprises a strap 40 which is connected to a strap receiver 23 of the shoulder arch $\mathbf{34}_x$ so as to permit pivotal movement of the shoulder protector $\mathbf{38}_x$ relative to the shoulder arch $\mathbf{34}_x$. In other cases, the shoulder protector $\mathbf{38}_x$ may be connected to the shoulder arch $\mathbf{34}_x$ in various other ways to permit pivotal movement (e.g., the shoulder protector $\mathbf{38}_x$ may be sewed to the shoulder arch $\mathbf{34}_x$ so as to create a hinge-like connection between them).

In this embodiment, the shoulder protector $\mathbf{38}_x$ comprises protective padding 45 disposed between an inner liner 47 and an outer covering 83. The protective padding 45 provides padded protection to the shoulder $\mathbf{20}_x$. The protective padding 45 may comprise any suitable shock-absorbing material. For example, in this embodiment, the protective padding 45 comprises foam material. The foam material of the protective padding 45 may comprise any suitable polymeric foam. For instance, in some examples of implementation, the foam material of the protective padding 45 may comprise any foam previously mentioned herein. In some cases, the foam material of the protective padding 45 may include only one type of foam. In other cases, the foam material of the protective padding 45 may include different types of foam in different areas of the shoulder protector $\mathbf{38}_x$.

The inner liner 47 comprises fabric material. The fabric material of the inner liner 47 may comprise any suitable fabric. For instance, in some examples of implementation, the fabric material of the inner liner 47 may comprise any fabric previously mentioned herein. In some cases, the fabric material of the inner liner 47 may include only one type of fabric. In other cases, the fabric material of the inner liner 47 may include different types of fabric in different areas of the shoulder protector $\mathbf{38}_x$. The outer covering 83 may comprise any suitable material. For example, in this embodiment, the outer covering 83 comprises flexible non-foam polymeric material (e.g., polyurethane). In this embodiment, since the outer covering 54 is flexible material, the shoulder cap constituted by the shoulder protector $\mathbf{38}_x$ is a flexible shoulder cap.

In this embodiment, the shoulder protector $38_x$ comprises a proximal section 96 and a distal section 97 connected to one another. The proximal section 96 comprises proximal portions of the protective padding 45, the inner liner 47, and of the outer covering 83, which, in this example, are interconnected by a stitched connecting band 98 that extends along a perimeter of the proximal section 96. Similarly, the distal section 97 comprises distal portions of the protective padding 45, the inner liner 47, and of the outer covering 83, which, in this example, are interconnected by a stitched connecting band 99 that extends along a perimeter of the distal section 97.

In this example of implementation, the proximal section 96 and the distal section are movable relative to one another. This may facilitate movement of the player 14 during play. More particularly, in this embodiment, the proximal section 96 and the distal section 97 are interconnected by an elastic zone 36 which stretches when the they are subjected to forces moving them away from one another and which contracts when these forces are no longer applied to bias them back towards one another. For instance, in this embodiment, the elastic zone 36 may comprise elastic "stretch" fabric.

The left and right shoulder protectors $38_1$, $38_2$ may be implemented in various other ways in other embodiments. For example, in other embodiments, each of the left and right shoulder protectors $38_1$, $38_2$ may have various other shapes, comprise various other components, and/or be made of various other materials. For instance, in some embodiments, each of the shoulder protectors $38_1$, $38_2$ may comprise an outer shell of rigid material (e.g., one or more shell pieces of polycarbonate or other rigid material). As another example, in other embodiments, each of the shoulder protectors $38_1$, $38_2$ may not comprise proximal and distal sections which can move relative to one another.

The left arm protector $21_1$ is configured to protect at least part of the left arm $24_1$ of the player. Similarly, the right arm protector $21_2$ is configured to protect at least part of the right arm $24_2$ of the player. Each arm protector $21_x$ comprises an outer arm portion 27 for overlying an outer region of the arm $24_x$ it protects and a strap 28 for retaining itself on the arm $24_x$.

In this embodiment, the arm protector $21_x$ depends from the shoulder protector $38_x$ protecting the shoulder $20_x$ joining the arm $24_x$. Also, in this embodiment, the arm protector $21_x$ is movable relative to the shoulder protector $38_x$. More particularly, in this example, the arm protector $21_x$ is pivotable relative to the shoulder protector $38_x$. In this case, the arm protector $21_x$ comprises a strap 29 which is connected to a strap receiver 22 of the shoulder protector $38_x$ so as to permit pivotal movement of the arm protector $21_x$ relative to the shoulder protector $38_x$. In other cases, the arm protector $21_x$ may be connected to the shoulder protector $38_x$ in various other ways to permit pivotal movement.

In this embodiment, the arm protector $21_x$ comprises protective padding 57 disposed between an inner liner 72 and an outer covering 79. The protective padding 57 provides padded protection to the arm $24_x$. The protective padding 57 may comprise any suitable shock-absorbing material. For example, in this embodiment, the protective padding 57 comprises foam material. The foam material of the protective padding 57 may comprise any suitable polymeric foam. For instance, in some examples of implementation, the foam material of the inner protective padding 57 may comprise any foam previously mentioned herein. In some cases, the foam material of the protective padding 57 may include only one type of foam. In other cases, the foam material of the protective padding may include different types of foam in different areas of the arm protector $21_x$.

The inner liner 72 comprises fabric material. The fabric material of the inner liner 72 may comprise any suitable fabric. For instance, in some examples of implementation, the fabric material of the inner liner 72 may comprise any fabric previously mentioned herein. In some cases, the fabric material of the inner liner 72 may include only one type of fabric. In other cases, the fabric material of the inner liner 72 may include different types of fabric in different areas of the arm protector $21_x$. The outer covering 79 may comprise any suitable material. For example, in this embodiment, the outer covering 79 comprises flexible non-foam polymeric material (e.g., polyurethane).

The left and right arm protectors $21_1$, $21_2$ may be implemented in various other ways in other embodiments. For example, in other embodiments, each of the left and right arm protectors $21_1$, $21_2$ may have various other shapes, comprise various other components, and/or be made of various other materials. For instance, in some embodiments, each of the arm protectors $21_1$, $21_2$ may comprise an outer shell of rigid material (e.g., one or more shell pieces of polycarbonate or other rigid material).

As mentioned previously, the adjustment system 40 allows the player to adjust the fit of the shoulder pads 10, notably by adjustment of the left and right shoulder arches $34_1$, $34_2$. In this embodiment, the adjustment system 40 comprises a left shoulder arch fastener $90_1$ detachably fastening the left shoulder arch $34_1$ to the front member 30 to allow the player to adjust the left shoulder arch $34_1$ and a right shoulder arch fastener $90_2$ detachably fastening the right shoulder arch $34_2$ to the front member 30 to allow the player to adjust the right shoulder arch $34_2$.

Each shoulder arch fastener $90_x$ detachably fastens its associated shoulder arch $34_x$ to the front member 30 in that it is designed to enable the shoulder arch $34_x$ and the front member 30 to be fastened and unfastened at will without damaging the shoulder pads 10. The shoulder arch fastener $90_x$ comprises a first connector 93 on (i.e., that is part of) the shoulder arch $34_x$ and a second connector 94 on (i.e., that is part of) the front member 30. When the shoulder arch $34_x$ is fastened to the front member 30 by the shoulder arch fastener $90_x$, the first connector 93 overlaps the front member 30 and is detachably connected to the second connector 94.

The shoulder arch fastener $90_x$ may be any suitable type of fastener. In this embodiment, the shoulder arch fastener $90_x$ is a hook-and-loop fastener. More particularly, in this embodiment, the shoulder arch fastener $90_x$ is a Velcro™ hook-and-loop fastener. In this example, the first connector 93 comprises a hook portion of the hook-and-loop fastener $90_x$ and the second connector 94 comprises a loop portion of the hook-and-loop fastener $90_x$. In other examples, this may be reversed with the first connector 93 comprising a loop portion of the hook-and-loop fastener $90_x$ and the second connector 94 comprising a hook portion of the hook-and-loop fastener $90_x$.

In this embodiment, the second connector 94 of the shoulder arch fastener $90_x$ comprises a first part 661 on (i.e., that is part of) the central section 55 of the front member 30 and a second part 662 on (i.e., that is part of) the lateral section $56_x$ of the front member 30. The first and second parts 661, 662 of the second connector 94 are thus movable relative to one another to accommodate relative movement of the central and lateral sections 55, $56_x$ of the front member 30.

The shoulder arch fastener $90_x$ allows the player to adjust a position in which the first connector 93 of the shoulder arch fastener $90_x$ is detachably connected to the second connector 94 of the shoulder arch fastener $90_x$. More particularly, in this embodiment, the shoulder arch fastener $90_x$ allows the player to adjust the position in which the first connector 93 is detachably connected to the second connector 94 in the front-back direction of the shoulder pads 10. Also, in this embodiment, the shoulder arch fastener $90_x$ allows the player to adjust the position in which the first connector 93 is detachably connected to the second connector 94 in the left-right direction of the shoulder pads 10. In fact, in this embodiment, the shoulder arch fastener $90_x$ allows the player to omnidirectionally adjust (i.e., adjust in any direction) the position in which the first connector 93 is detachably connected to the second connector 94. In this case, this positional adjustment allows the player to adjust an orientation of the shoulder arch $34_x$ relative to the front member 30.

For instance, FIGS. 9A, 9B, 10A and 10B show examples of how the position in which the first connector 93 of the shoulder arch fastener $90_x$ is detachably connected to the second connector 94 of the shoulder arch fastener $90_x$ is adjustable along the front-back direction and the left-right direction of the shoulder pads 10. In the example shown in FIGS. 9A and 9B, the position in which the first connector 93 is detachably connected to the second connector 94 is centered at point P1. In the example shown in FIGS. 10A and 10B, the position in which first connector 93 is detachably connected to the second connector 94 is centered at a point P2. The point P1 and the point P2 are spaced apart in the front-back direction and in the left-right direction of the shoulder pads 10. Also, the orientation of the shoulder arch $34_x$ relative to the front member 30 is different in the example shown in FIGS. 9A and 9B than in the example shown in FIGS. 10A and 10B.

The adjustment of the left and right shoulder arches $34_1$, $34_2$ enabled by the left and right shoulder arch fasteners $90_1$, $90_2$ allows various aspects of the fit of the shoulder pads 10 to be adjusted.

For example, in this embodiment, the shoulder arch fastener $90_x$ allows the player to adjust a length of a segment 95 of the shoulder arch $34_x$ defining a dimension NFB of the neck opening 39 in the front-back direction of the shoulder pads 10. For instance, the length of the segment 95 of the shoulder arch $34_x$ is longer and results in the dimension NFB of the neck opening 39 in the front-back direction of the shoulder pads 10 being greater in the example shown in FIGS. 9A and 9B than in the example shown in FIGS. 10A and 10B.

Also, in this embodiment, the left and right shoulder arch fasteners $90_1$, $90_2$ allow the player to adjust a distance W between the left shoulder arch $34_1$ and the right shoulder arch $34_2$ in the left-right direction of the shoulder pads 10 which defines a spacing S of the left shoulder protector $38_1$ and the right shoulder protector $38_2$ in the left-right direction of the shoulder pads 10. For instance, the distance W between the left and right shoulder arches $34_1$, $34_2$ in the left-right direction of the shoulder pads 10 is greater and results in the spacing S of the left and right shoulder protectors $38_1$, $38_2$ in the left-right direction of the shoulder pads 10 being greater in the example shown in FIGS. 9A and 9B than in the example shown in FIGS. 10A and 10B. In this case, the distance W between the left and right shoulder arches $34_1$, $34_2$ corresponds to the spacing S of the left and right shoulder protectors $38_1$, $38_2$ since the left and right shoulder protectors $38_1$, $38_2$ are mounted to the left and right shoulder arches $34_1$, $34_2$ such that their respective neck-facing edges generally coincide. In other cases, the distance W between the left and right shoulder arches $34_1$, $34_2$ may be different than the spacing S of the left and right shoulder protectors $38_1$, $38_2$.

Figure 11:
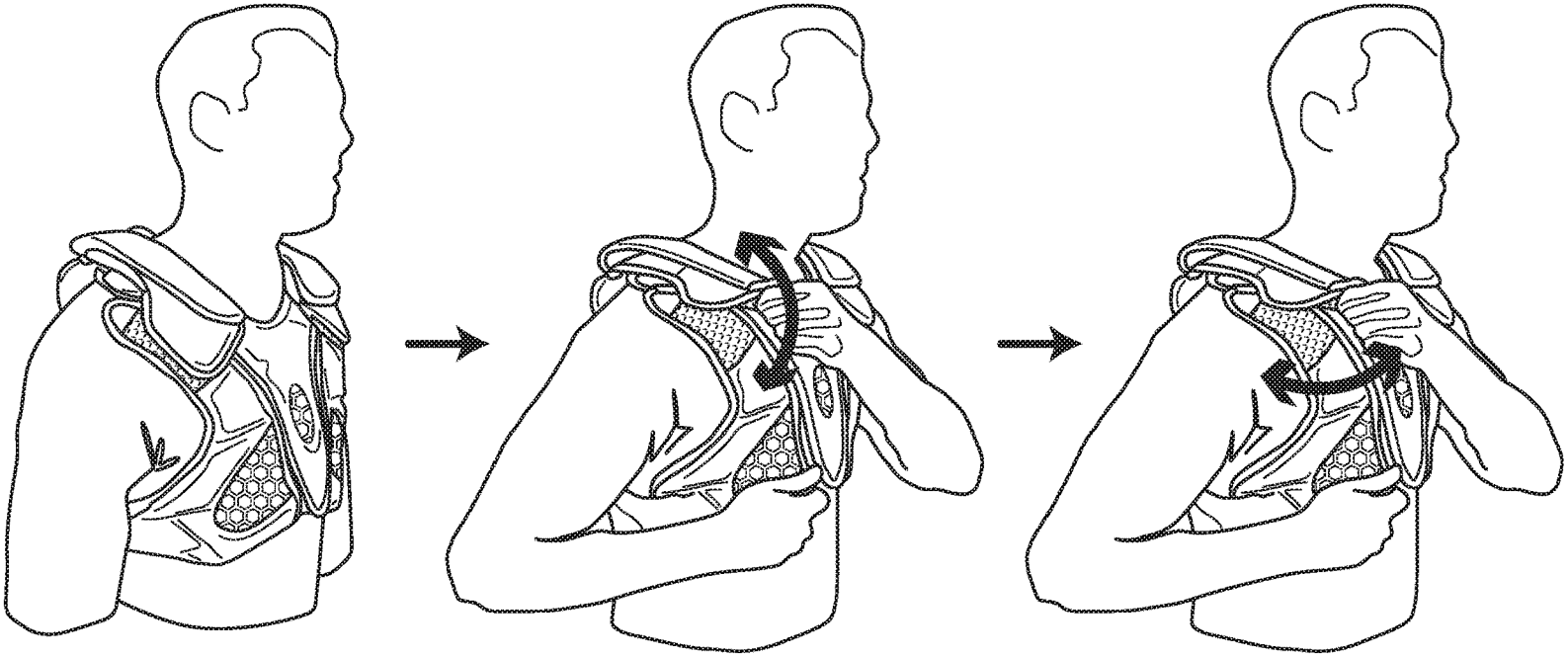
FIG. 11 shows an example of how the adjustment system allows the player to adjust the shoulder pads while wearing the shoulder pads.

As shown in FIG. 11, in this embodiment, the left and right shoulder arch fasteners $90_1$, $90_2$ allow the player to adjust the left and right shoulder arches $34_1$, $34_2$ while the player is wearing the shoulder pads 10. Indeed, in this embodiment, since the left and right shoulder arch fasteners $90_1$, $90_2$ are located on the front side FS of the thorax 12 of the player 14, they can be easily accessed and manipulated by the player while he/she is wearing the shoulder pads 10. This can be beneficial since it can help the player to easily adjust the fit of the shoulder pads 10 without having to take them off and but them back on.

In this embodiment, the first connector 93 of the shoulder arch fastener $90_x$ has a dimension C1W in the left-right direction of the shoulder pads 10 and a dimension C1H in the top-bottom direction of the shoulder pads 10 that are sized to permit the adjustment of the position in which the first connector 93 is detachably connected to the second connector 94 of the shoulder arch fastener $90_x$. For example, in some embodiments, the dimension C1W of the first connector 93 in the left-right direction of the shoulder pads 10 may be at least 1 inch, in some cases at least 2 inches, in some cases at least 3 inches, and in some cases even more (e.g., up to 6 inches) and/or the dimension C1H of the first connector 93 in the top-bottom direction of the shoulder pads 10 may be at least 1 inch, in some cases at least 2 inches, in some cases at least 3 inches, and in some cases even more (e.g., up to 6 inches). The dimensions C1W and C1H of the first connector 93 in the left-right and top-bottom directions of the shoulder pads 10 may have any other suitable values in other embodiments.

Similarly, the second connector 94 of the shoulder arch fastener $90_x$ has a dimension C2W in the left-right direction of the shoulder pads 10 and a dimension C2H in the top-bottom direction of the shoulder pads 10 that are suitably sized to permit the adjustment of the position in which the first connector 93 is detachably connected to the first connector 93 of the shoulder arch fastener $90_x$. For example, in some embodiments, the dimension C2W of the second connector 94 in the left-right direction of the shoulder pads 10 may be at least 1 inch, in some cases at least 2 inches, in some cases at least 3 inches, and in some cases even more (e.g., up to 6 inches) and/or the dimension C2H of the second connector 94 in the top-bottom direction of the shoulder pads 10 may be at least 1 inch, in some cases at least 2 inches, in some cases at least 3 inches, and in some cases even more (e.g., up to 6 inches). The dimensions C2W and C2H of the second connector 94 in the left-right and top-bottom directions of the shoulder pads 10 may have any other suitable values in other embodiments.

The left and right shoulder arch fasteners $90_1$, $90_2$ may be implemented in various other ways in other embodiments.

For example, in other embodiments, the first and second connectors 93, 94 of the shoulder arch fastener $90_x$ may have various other shapes and/or may be located elsewhere on the shoulder arch $34_x$ and/or on the front member 30.

As another example, in other embodiments, the shoulder arch fastener $90_x$ may be any other type of fastener and each of its first and second connectors 93, 94 may comprise any other type of connecting elements (e.g., a button, a clip, a buckle, a snap, etc.). For instance, in some embodiments, the second connector 94 may comprise a plurality of distinct connecting elements which are spaced apart from one another such that the first connector 93 can be connected to a selected one of these distinct connecting elements to adjust the shoulder arch $\mathbf{34}_x$. For example, in some cases, the distinct connecting elements of the second connector 94 may be female snap button elements and the first connector 93 may comprise a male snap button element that can be connected to a selected one of the female snap button elements to adjust the shoulder arch $\mathbf{34}_x$ (e.g., the shoulder arch fastener $\mathbf{90}_x$ may be a button-type fastener). In other cases, the distinct connecting elements of the second connector 94 may be grommets and the first connector 93 may comprise a plug that can be connected to a selected one of the grommets by insertion therethrough to adjust the shoulder arch $\mathbf{34}_x$ (i.e., the shoulder arch fastener $\mathbf{90}_x$ may be a plug-and-grommet fastener). In other embodiments, the second connector 94 may define different positions at which the first connector 93 can be connected, but these different positions may not necessarily be defined by distinct connecting elements. For example, in some cases, the second connector 94 may comprise a connection area of the front member 30 such that the first connector 93 is connectable to any of various positions within the connection area (e.g., the first connector 93 may comprise a clip that can be connected to any position in the connection area that is clippable by the clip). Various other types of connecting elements may be used in other cases.

As yet another example, instead of being part of the front member 30, the second connector 94 of the shoulder arch fastener $\mathbf{90}_x$ may be part of the back member 30 in other embodiments. For instance, in some embodiments, the shoulder arch $\mathbf{34}_x$ may be sewn, integrally formed with, or otherwise nonseparably connected to the front member 30 and extend towards the back member 30 such that the first connector 93 on the shoulder arch $\mathbf{34}_x$ can be detachably connected to the second connector 94 on the back member 32.

While in this embodiment the shoulder pads 10 are lacrosse shoulder pads, in other embodiments, shoulder pads constructed using principles described herein in respect of the shoulder pads 10 may be another type of shoulder pads for upper body protection of a player playing another type of contact sport (sometimes referred to as "full-contact sport" or "collision sport") in which there are significant impact forces on the player due to player-to-player and/or player-to-object contact. For example, in other embodiments, shoulder pads constructed using principles described herein in respect of the shoulder pads 10 may be hockey shoulder pads for upper body protection of a hockey player. As another example, in other embodiments, shoulder pads constructed using principles described herein in respect of the shoulder pads 10 may be football shoulder pads for upper body protection of a football player.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. Shoulder pads for a player playing a contact sport, said shoulder pads comprising:

a) a front member for covering at least part of a front side of a thorax of the player, said front member comprising protective padding;

b) a back member for covering at least part of a back side of the thorax of the player;

c) a left shoulder arch for arching over a left shoulder of the player and interconnecting said front member and said back member;

d) a right shoulder arch for arching over a right shoulder of the player and interconnecting said front member and said back member;

e) a left shoulder arch fastener detachably fastening said left shoulder arch to said front member, said left shoulder arch fastener comprising a first connector on said left shoulder arch and a second connector on said front member, said first connector of said left shoulder arch fastener being detachably connected to said second connector of said left shoulder arch fastener; and f) a right shoulder arch fastener detachably fastening said right shoulder arch to said front member, said right shoulder arch fastener comprising a first connector on said right shoulder arch and a second connector on said front member, said first connector of said right shoulder arch fastener being detachably connected to said second connector of said right shoulder arch fastener.

2. The shoulder pads of claim 1, wherein said left shoulder arch fastener and said right shoulder arch fastener allow the player to adjust said left shoulder arch and said right shoulder arch in a front-back direction of said shoulder pads.

3. The shoulder pads of claim 2, wherein said left shoulder arch fastener and said right shoulder arch fastener allow the player to adjust a distance between said left shoulder arch and said right shoulder arch in a left-right direction of said shoulder pads.

4. The shoulder pads of claim 1, wherein said left shoulder arch fastener and said right shoulder arch fastener allow the player to adjust said left shoulder arch and said right shoulder arch while the player is wearing said shoulder pads.

5. The shoulder pads of claim 1, wherein: said left shoulder arch fastener allows the player to adjust a position in which said first connector of said left shoulder arch fastener is detachably connected to said second connector of said left shoulder arch fastener in a front-back direction of said shoulder pads; and said right shoulder arch fastener allows the player to adjust a position in which said first connector of said right shoulder arch fastener is detachably connected to said second connector of said right shoulder arch fastener in said front-back direction of said shoulder pads.

6. The shoulder pads of claim 5, wherein: said left shoulder arch fastener allows the player to adjust the position in which said first connector of said left shoulder arch fastener is detachably connected to said second connector of said left shoulder arch fastener in a left-right direction of said shoulder pads; and said right shoulder arch fastener allows the player to adjust the position in which said first connector of said right shoulder arch fastener is detachably connected to said second connector of said right shoulder arch fastener in the left-right direction of said shoulder pads.

7. The shoulder pads of claim 1, wherein: said left shoulder arch fastener allows the player to omnidirectionally adjust a position in which said first connector of said left shoulder arch fastener is detachably connected to said second connector of said left shoulder arch fastener; and said right shoulder arch fastener allows the player to omnidirectionally adjust a position in which said first connector of said right shoulder arch fastener is detachably connected to said second connector of said right shoulder arch fastener.

8. The shoulder pads of claim 1, wherein: said left shoulder arch fastener allows the player to adjust an orientation of said left shoulder arch relative to said front member; and said right shoulder arch fastener allows the player to adjust an orientation of said right shoulder arch relative to said front member.

9. The shoulder pads of claim 1, wherein: said second connector of said left shoulder arch fastener has a dimension in a left-right direction of said shoulder pads of at least 1 inch and a dimension in a top-bottom direction of said shoulder pads of at least 1 inch; and said second connector of said right shoulder arch fastener has a dimension in the left-right direction of said shoulder pads of at least 1 inch and a dimension in the top-bottom direction of said shoulder pads of at least 1 inch.

10. The shoulder pads of claim 9, wherein: the dimension of said second connector of said left shoulder arch fastener in the left-right direction of said shoulder pads is at least 2 inches and the dimension of said second connector of said left shoulder arch fastener in the top-bottom direction of said shoulder pads is at least 2 inches; and the dimension of said second connector of said right shoulder arch fastener in the left-right direction of said shoulder pads is at least 2 inches and the dimension of said second connector of said right shoulder arch fastener in the top-bottom direction of said shoulder pads is at least 2 inches.

11. The shoulder pads of claim 1, wherein said left shoulder arch fastener is a left hook-and-loop fastener and said right shoulder arch fastener is a right hook-and-loop fastener.

12. The shoulder pads of claim 11, wherein: said first connector of said left shoulder arch fastener comprises a hook portion of said left hook-and-loop fastener and said second connector of said left shoulder arch fastener comprises a loop portion of said left hook-and-loop fastener; and said first connector of said right shoulder arch fastener comprises a hook portion of said right hook-and-loop fastener and said second connector of said right shoulder arch fastener comprises a loop portion of said right hook-and-loop fastener.

13. The shoulder pads of claim 1, wherein: said left shoulder arch comprises a left shoulder-arching strap extending from said back member to said front member; and said right shoulder arch comprises a right shoulder-arching strap extending from said back member to said front member.

14. The shoulder pads of claim 1, wherein: said left shoulder arch is nonseparably connected to said back member and extends towards said front member; and said right shoulder arch is nonseparably connected to said back member and extends towards said front member.

15. The shoulder pads of claim 14, wherein: said left shoulder arch is nonseparably connected to said back member by being sewed to said back member; and said right shoulder arch is nonseparably connected to said back member by being sewed to said back member.

16. The shoulder pads of claim 1, wherein: said first connector of said left shoulder arch fastener comprises protective padding; and said first connector of said right shoulder arch fastener comprises protective padding.

17. The shoulder pads of claim 1, comprising a left arm protector for protecting at least part of a left arm of the player and a right arm protector for protecting at least part of a right arm of the player.

18. The shoulder pads of claim 17, comprising a left shoulder protector for protecting at least part of the left shoulder of the player and a right shoulder protector for protecting at least part of the right shoulder of the player, wherein said left arm protector depends from said left shoulder protector and said right arm protector depends from said right shoulder protector.

19. The shoulder pads of claim 1, wherein said back member comprises protective padding.

20. The shoulder pads of claim 1, wherein the contact sport is lacrosse and said shoulder pads are lacrosse shoulder pads.

21. The shoulder pads of claim 1, comprising a left shoulder protector for protecting at least part of the left shoulder of the player and a right shoulder protector for protecting at least part of the right shoulder of the player.

22. The shoulder pads of claim 21, wherein: said left shoulder protector is mounted over said left shoulder arch; and said right shoulder protector is mounted over said right shoulder arch.

23. The shoulder pads of claim 22, wherein: said left shoulder protector is movable relative to said left shoulder arch; and said right shoulder protector is movable relative to said right shoulder arch.

24. The shoulder pads of claim 23, wherein: said left shoulder protector is movable relative to said left shoulder arch by being pivotable relative to said left shoulder arch; and said right shoulder protector is movable relative to said right shoulder arch by being pivotable relative to said right shoulder arch.

25. The shoulder pads of claim 21, wherein: said left shoulder protector comprises protective padding and is flexible; and said right shoulder protector comprises protective padding and is flexible.

26. The shoulder pads of claim 1, wherein said left shoulder arch fastener and said right shoulder arch fastener allow the player to adjust said left shoulder arch and said right shoulder arch while the player is wearing said shoulder pads by:

moving said first connector of said left shoulder arch fastener away from said front member to detach said first connector of said left shoulder arch fastener from said second connector of said left shoulder arch fastener and subsequently moving said first connector of said left shoulder arch fastener towards said front member to reconnect said first connector of said left shoulder arch fastener to said second connector of said left shoulder arch fastener; and moving said first connector of said right shoulder arch fastener away from said front member to detach said first connector of said right shoulder arch fastener from said second connector of said right shoulder arch fastener and subsequently moving said first connector of said right shoulder arch fastener towards said front member to reconnect said first connector of said right shoulder arch fastener to said second connector of said right shoulder arch fastener.

27. The shoulder pads of claim 1, wherein said left shoulder arch fastener and said right shoulder arch fastener are exposed at a front of the shoulder pads.

28. The shoulder pads of claim 1, wherein said first connector of said left shoulder arch fastener is at least partly located in a clavicular portion of said left shoulder arch and said first connector of said right shoulder arch fastener is at least partly located in a clavicular portion of said right shoulder arch.

29. The shoulder pads of claim 28, wherein said second connector of said left shoulder arch fastener is at least partly located in a left clavicular region of said front member and said second connector of said right shoulder arch fastener is at least partly located in a right clavicular region of said front member.

30. The shoulder pads of claim 29, wherein said left shoulder arch fastener is a left hook-and-loop fastener and said right shoulder arch fastener is a right hook-and-loop fastener.

31. The shoulder pads of claim 1, wherein said left shoulder arch fastener and said right shoulder arch fastener are unfastenable to disconnect said left shoulder arch and said right shoulder arch from said front member such that said front member is separated from said left shoulder arch and said right shoulder arch.

32. The shoulder pads of claim 31, wherein said left shoulder arch fastener and said right shoulder arch fastener are unfastenable to disconnect said left shoulder arch and said right shoulder arch from said front member such that said front member is separated from said back member.

33. The shoulder pads of claim 1, wherein: said left shoulder arch comprises a scapular portion and a clavicular portion that is larger than the scapular portion of said left shoulder arch; and said right shoulder arch comprises a scapular portion and a clavicular portion that is larger than the scapular portion of said right shoulder arch.

34. The shoulder pads of claim 27, wherein said first connector of said left shoulder arch fastener is at least partly located in a clavicular portion of said left shoulder arch and said first connector of said right shoulder arch fastener is at least partly located in a clavicular portion of said right shoulder arch.

35. Shoulder pads for a player playing a contact sport, the shoulder pads comprising:

a) a front member for covering at least part of a front side of a thorax of the player, the front member comprising protective padding;

b) a back member for covering at least part of a back side of the thorax of the player;

c) a left shoulder arch for arching over a left shoulder of the player and interconnecting the front member and the back member; and d) a right shoulder arch for arching over a right shoulder of the player and interconnecting the front member and the back member;

wherein each of the left shoulder arch and the right shoulder arch is detachably fastened to the front member.

36. The shoulder pads of claim 35, wherein each of the left shoulder arch and the right shoulder arch is detachably fastened to the front member so as to be detachable from the front member while the player is wearing the shoulder pads.

37. The shoulder pads of claim 36, wherein each of the left shoulder arch and the right shoulder arch is detachably fastened to the front member to allow the player to adjust the left shoulder arch and the right shoulder arch while the player is wearing the shoulder pads.

38. The shoulder pads of claim 37, wherein each of the left shoulder arch and the right shoulder arch is detachably fastened to the front member to allow the player to adjust the left shoulder arch and the right shoulder arch in a front-back direction of the shoulder pads.

39. The shoulder pads of claim 38, wherein each of the left shoulder arch and the right shoulder arch is detachably fastened to the front member to allow the player to adjust a distance between the left shoulder arch and the right shoulder arch in a left-right direction of the shoulder pads.

40. The shoulder pads of claim 35, wherein each of the left shoulder arch and the right shoulder arch is detachably fastened to the front member to allow the player to adjust a position in which the left shoulder arch is detachably fastened to the front member in a front-back direction of the shoulder pads and adjust a position in which the right shoulder arch is detachably fastened to the front member in the front-back direction of the shoulder pads.

41. The shoulder pads of claim 40, wherein each of the left shoulder arch and the right shoulder arch is detachably fastened to the front member to allow the player to adjust the position in which the left shoulder arch is detachably fastened to the front member in a left-right direction of the shoulder pads and adjust the position in which the right shoulder arch is detachably fastened to the front member in the left-right direction of the shoulder pads.

42. The shoulder pads of claim 35, wherein each of the left shoulder arch and the right shoulder arch is detachably fastened to the front member to allow the player to omnidirectionally adjust a position in which the left shoulder arch is detachably fastened to the front member and omnidirectionally adjust a position in which the right shoulder arch is detachably fastened to the front member.

43. The shoulder pads of claim 35, wherein each of the left shoulder arch and the right shoulder arch is detachably fastened to the front member to allow the player to adjust an orientation of the left shoulder arch relative to the front member and adjust an orientation of the right shoulder arch relative to the front member.

44. The shoulder pads of claim 35, comprising: a connector on the left shoulder arch and a left connector on the front member detachably connected to one another to detachably fasten the left shoulder arch to the front member; and a connector on the right shoulder arch and a right connector on the front member detachably connected to one another to detachably fasten the right shoulder arch to the front member, wherein: the left connector of the front member has a dimension in a left-right direction of the shoulder pads of at least 1 inch and a dimension in a top-bottom direction of the shoulder pads of at least 1 inch; and the right connector of the front member has a dimension in the left-right direction of the shoulder pads of at least 1 inch and a dimension in the top-bottom direction of the shoulder pads of at least 1 inch.

45. The shoulder pads of claim 35, comprising: a connector on the left shoulder arch and a left connector on the front member detachably connected to one another to detachably fasten the left shoulder arch to the front member; and a connector on the right shoulder arch and a right connector on the front member detachably connected to one another to detachably fasten the right shoulder arch to the front member, wherein: the left connector of the front member has a dimension in a left-right direction of the shoulder pads of at least 2 inches and a dimension in a top-bottom direction of the shoulder pads of at least 2 inches; and the right connector of the front member has a dimension in the left-right direction of the shoulder pads of at least 2 inches and a dimension in the top-bottom direction of the shoulder pads of at least 2 inches.

46. The shoulder pads of claim 35, comprising a left hook-and-loop fastener detachably fastening the left shoulder arch to the front member and a right hook-and-loop fastener detachably fastening the right shoulder arch to the front member.

47. The shoulder pads of claim 46, wherein: the left hook-and-loop fastener comprises a hook portion on the left shoulder arch and a loop portion on the front member; and the right hook-and-loop fastener comprises a hook portion on the right shoulder arch and a loop portion on the front member.

48. The shoulder pads of claim 35, wherein: the left shoulder arch is nonseparably connected to the back member and extends towards the front member; and the right shoulder arch is nonseparably connected to the back member and extends towards the front member.

49. The shoulder pads of claim 48, wherein: the left shoulder arch is nonseparably connected to the back member by being sewed to the back member; and the right shoulder arch is nonseparably connected to the back member by being sewed to the back member.

50. The shoulder pads of claim 35, comprising: a connector on the left shoulder arch and a left connector on the front member detachably connected to one another to detachably fasten the left shoulder arch to the front member; and a connector on the right shoulder arch and a right connector on the front member detachably connected to one another to detachably fasten the right shoulder arch to the front member, wherein: the connector of the left shoulder arch comprises protective padding; and the connector of the right shoulder arch comprises protective padding.

51. The shoulder pads of claim 35, comprising a left shoulder protector for protecting at least part of the left shoulder of the player and a right shoulder protector for protecting at least part of the right shoulder of the player.

52. The shoulder pads of claim 51, wherein: the left shoulder protector is mounted over the left shoulder arch; and the right shoulder protector is mounted over the right shoulder arch.

53. The shoulder pads of claim 51, wherein: the left shoulder protector is movable relative to the left shoulder arch; and the right shoulder protector is movable relative to the right shoulder arch.

54. The shoulder pads of claim 35, comprising a left arm protector for protecting at least part of a left arm of the player and a right arm protector for protecting at least part of a right arm of the player.

55. The shoulder pads of claim 54, comprising a left shoulder protector for protecting at least part of the left shoulder of the player and a right shoulder protector for protecting at least part of the right shoulder of the player, wherein the left arm protector depends from the left shoulder protector and the right arm protector depends from the right shoulder protector.

56. The shoulder pads of claim 35, wherein the back member comprises protective padding.

57. The shoulder pads of claim 35, wherein the left shoulder arch and the right shoulder arch are adjustable while the player is wearing the shoulder pads by:

moving the left shoulder arch away from the front member to detach the left shoulder arch from the front member and subsequently moving the left shoulder arch towards the front member to reconnect the left shoulder arch to the front member; and moving the right shoulder arch away from the front member to detach the right shoulder arch from the front member and subsequently moving the right shoulder arch towards the front member to reconnect the right shoulder arch to the front member.

58. The shoulder pads of claim 35, wherein a left shoulder arch fastener detachably fastening the left shoulder arch to the front member and a right shoulder arch fastener are exposed at a front of the shoulder pads.

59. The shoulder pads of claim 35, comprising: a connector on the left shoulder arch and a left connector on the front member detachably connected to one another to detachably fasten the left shoulder arch to the front member; and a connector on the right shoulder arch and a right connector on the front member detachably connected to one another to detachably fasten the right shoulder arch to the front member, wherein: the connector of the left shoulder arch is at least partly located in a clavicular portion of the left shoulder arch and the connector of the right shoulder arch is at least partly located in a clavicular portion of the right shoulder arch.

60. The shoulder pads of claim 59, wherein the left connector of the front member is at least partly located in a left clavicular region of the front member and the right connector of the front member is at least partly located in a right clavicular region of the front member.

61. The shoulder pads of claim 60, wherein the connector of the left shoulder arch and the left connector of the front member constitute a left hook-and-loop fastener and the connector of the right shoulder arch and the right connector of the front member constitute a right hook-and-loop fastener.

62. The shoulder pads of claim 35, wherein the left shoulder arch and the right shoulder arch are unfastenable from the front member to disconnect the left shoulder arch and the right shoulder arch from the front member such that the front member is separated from the left shoulder arch and the right shoulder arch.

63. The shoulder pads of claim 62, wherein the left shoulder arch and the right shoulder arch are unfastenable from the front member to disconnect the left shoulder arch and the right shoulder arch from the front member such that the front member is separated from the back member.

64. The shoulder pads of claim 35, wherein: the left shoulder arch comprises a scapular portion and a clavicular portion that is larger than the scapular portion of the left shoulder arch; and the right shoulder arch comprises a scapular portion and a clavicular portion that is larger than the scapular portion of the right shoulder arch.

65. The shoulder pads of claim 35, wherein the contact sport is lacrosse and said shoulder pads are lacrosse shoulder pads.

66. Shoulder pads for a player playing a contact sport, the shoulder pads comprising:

a) a front member for covering at least part of a front side of a thorax of the player, the front member comprising protective padding;

b) a back member for covering at least part of a back side of the thorax of the player;

c) a left shoulder arch for arching over a left shoulder of the player and interconnecting the front member and the back member;

d) a right shoulder arch for arching over a right shoulder of the player and interconnecting the front member and the back member;

e) a connector on the left shoulder arch and a left connector on the front member detachably connected to one another to detachably fasten the left shoulder arch to the front member, the connector of the left shoulder arch being at least partly located in a clavicular portion of the left shoulder arch, the left connector of the front member being at least partly located in a left clavicular region of the front member; and f) a connector on the right shoulder arch and a right connector on the front member detachably connected to one another to detachably fasten the right shoulder arch to the front member, the connector of the right shoulder arch being at least partly located in a clavicular portion of the right shoulder arch, the right connector of the front member being at least partly located in a right clavicular region of the front member.

67. The shoulder pads of claim 66, wherein the connector of the left shoulder arch and the left connector of the front member constitute a left hook-and-loop fastener and the connector of the right shoulder arch and the right connector of the front member constitute a right hook-and-loop fastener.

* * * * *